US006422978B2

(12) United States Patent
Bouvier

(10) Patent No.: US 6,422,978 B2
(45) Date of Patent: Jul. 23, 2002

(54) EXERCISE ROPE

(76) Inventor: Ronald O. Bouvier, 67 Powers Mill Rd., Phillipston, MA (US) 01331

( * ) Notice: Subject to any disclaimer, the term of this patent is extended or adjusted under 35 U.S.C. 154(b) by 0 days.

(21) Appl. No.: 09/775,047

(22) Filed: Feb. 1, 2001

Related U.S. Application Data

(60) Provisional application No. 60/179,556, filed on Feb. 1, 2000.

(51) Int. Cl.[7] ..... A63B 5/20
(52) U.S. Cl. ..... 482/82; 482/81
(58) Field of Search ..... 482/81, 82, 126, 482/148, 91

(56) References Cited

U.S. PATENT DOCUMENTS 98,928 A * 1/1870 Coon ..... 482/82
2,723,121 A * 11/1955 Cartwright et al. ..... 482/82
4,201,382 A * 5/1980 Wilson ..... 482/82
5,092,583 A * 3/1992 Rudolf ..... 482/82

* cited by examiner

*Primary Examiner*—Jerome Donnelly
(74) *Attorney, Agent, or Firm*—Blodgett & Blodgett, P.C.

(57) ABSTRACT

A jump rope consisting of an elongated cord extending between a pair of handles. The cord has a pair of end portions connected to the handles, a mid portion and a pair of intermediate portions between the mid portion and the end portions. Each of the intermediate portions has a weight per unit length that is two to four times that of the remaining portions of the cord. More specifically, the length of each intermediate portion is from 10% to 24% of the total length of the cord and the length of each end portion is from 8% to 12% of the total length of the cord. In one embodiment, the extra weight of each intermediate portion is achieved by having the thickness of the intermediate portion greater than the other portions of the cord. In another embodiment, the extra weight of each intermediate section is achieved by having beads strung on the intermediate sections.

6 Claims, 2 Drawing Sheets

EXERCISE ROPE

CROSS-REFERENCE TO RELATED APPLICATIONS

This application claims the benefit under 35 U.S.C. §119 (*e*) of prior U.S. Provisional Application Ser. No. 60/179,556 filed Feb. 1, 2000; which is hereby incorporated by reference.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention is directed to an exercise rope commonly referred to as a "jump rope" or "skip rope". Jump ropes are usually made of a length of rope or cord having handles at each end. The handles are gripped by the user's hands and the rope is swung over the user's head and under the user's feet in a continuous motion. The user jumps or skips in coordination with the swinging of the rope so that the feet are lifted just before the rope approaches the feet, thereby allowing the rope to pass beneath the feet. Jump roping or skip roping is used by many individuals as the aerobic exercise component of an overall fitness program. Jump roping also provides toning of certain muscle groups involved in the swinging of the rope and in jumping. However, many individuals who exercise choose not to use a jump rope. Either they do not find jump roping to be an enjoyable or satisfying exercise or they have difficulty with the timing aspect of jump roping. If the rope is too light it is difficult for the user to develop a "feel" for the rope and to achieve proper timing between jumping and passing the rope beneath the user's feet. If the rope is too heavy, it tends to shift the jump roping or skip roping from a predominantly aerobic and toning exercise to an arm strengthening exercise. There have been attempts to increase the weight of the middle portion of the rope which passes beneath the user's feet. This type of jump rope tends to place too much strain on the user's arm joints, the shoulders in particular, and has not been accepted by the public. There is also a tendency for the rope to narrow down in the middle and get caught on the user's feet. These and other difficulties experienced with the prior art jump ropes have been obviated in a novel manner by the present invention.

It is, therefore, a principal object of the invention to provide a jump rope that is dynamically balanced for making the jump rope easy to use while enabling the use to achieve the aerobic and toning benefits normally associated with the use of a jump rope.

Another object of this invention is the provision of a jump rope which is dynamically balanced so as to require less effort in swinging the jump rope, thereby enabling a user to exercise with the jump rope for a longer period of time.

SUMMARY OF THE INVENTION

A jump rope consisting of an elongated cord extending between a pair of handles. The cord has a pair of end portions connected to the handles, a mid portion and a pair of intermediate portions between the mid portion and the end portions. Each of the intermediate portions has a weight per unit length that is two to four times that of the remaining portions of the cord. More specifically, the length of each intermediate portion is from 10% to 24% of the total length of the cord and the length of each end portion is from 8% to 12% of the total length of the cord. In one embodiment of the invention, the extra weight of each intermediate portion is achieved by having the thickness of the intermediate portion greater than the other portions of the cord. In another embodiment of the invention, the extra weight of each intermediate section is achieved by having beads strung on the intermediate sections.

BRIEF DESCRIPTION OF THE DRAWINGS

The character of the invention, however, may be best understood by reference to one of its structural forms, as illustrated by the accompanied drawings, in which.

DETAILED DESCRIPTION OF THE INVENTION

Figure 1:
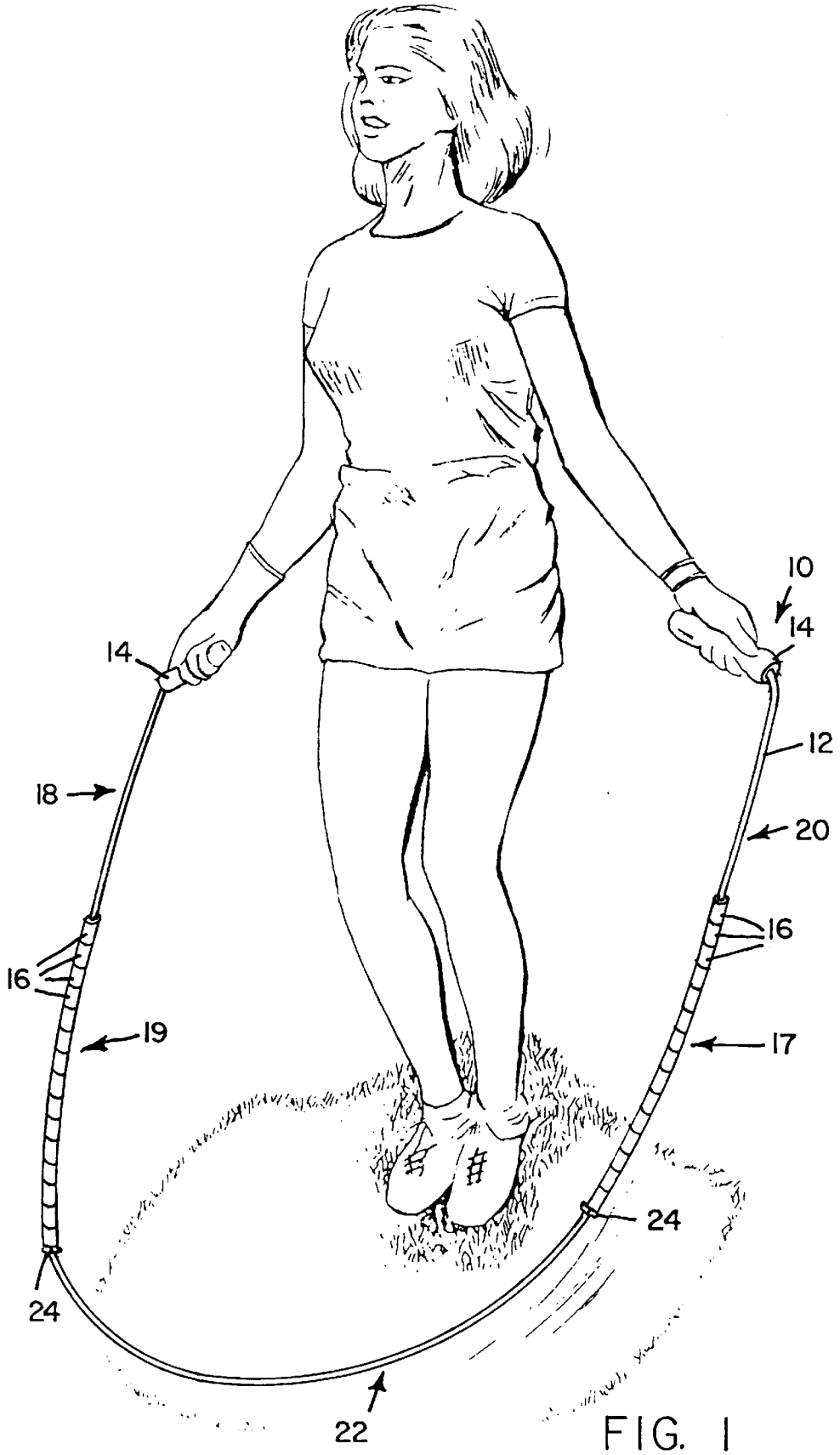
FIG. 1 is an isometric view of a jump rope embodying the principals of the present invention and shown in use.

Referring to FIG. 1, the jump rope of the present invention is generally indicated by the reference numeral 10, and comprises a plurality of tubular plastic beads 16 strung loosely on a plastic cord 12. The ends of the cord 12 are connected to a pair of swivel handles 14 of any conventional design, such as shown in my U.S. Pat. No. 4,136,866. The beads 16 are arranged in two spaced groups. The groups of beads are located along intermediate beaded sections of the cord, generally indicated by the reference numerals 17 and 19. Sections 17 and 19 are spaced from each other by a mid bead free section at the middle of the cord and generally indicated by the reference numeral 22. The beaded section 19 is spaced from the adjacent handle 14 by a first bead free end section, generally indicated by the reference numeral 18. The beaded section 17 is spaced from the opposite handle 14 by a second bead free end section, generally indicated by the reference numeral 20. The middle bead free section 22 is defined by a pair of metal clips 24 which are crimped to the cord 12 to prevent the beads 16 from sliding along the cord into the mid section 22. The same results can also be achieved by fastening the innermost bead from each of the sections 17 and 19 by a fastener such as a staple. The outermost bead in each of the sections 17 and 19 can also be fastened to the cord 12 if desired. However, during use of the jump rope, all of the beads 16 will be forced by centrifugal force towards the clip 24. The length of the mid bead free section 22 is from 32% to 42% of the total length of the cord 12. The ideal length of the section 22 is 40% of the total length of the rope 10. The length of each of the beaded sections 17 and 19 is from 18% to 24% of the total length of the cord 12, 20% of the total length of the cord being the ideal length of each of the sections 17 and 19. The length of each of the bead free end sections 18 and 20 is from 8% to 12% for the total length of the cord 12, 10% of the total length of the cord 12 being the ideal length of each of the bead free end sections.

The cord 12 is a solid plastic extrusion. Each of the beads 16 is a plastic tube which is slidable on the cord 12. In the preferred embodiment, the cord 12 is approximately 5 mm in diameter. Each of the beads 16 has an outside diameter of approximately 9 mm and an inside diameter of approximately 6 mm. The cross-sectional area of each of the beads 16 is approximately twice as much as that of the cross-sectional area of the cord 12. Therefore, the total weight per unit length of each of the intermediate beaded sections 17 and 19 is approximately three times that of the weight per unit length of each of the mid and end bead free sections of the cord. Although this is the ideal weight ratio for most individuals, some individuals may prefer a larger or smaller weight ratio. It is believed that all individuals will experience an improved rope skipping performance with a rope that has a weight to unit length of the beaded sections which is two to four times the weight per unit length of that of the bead free sections. The beaded sections 17 and 19 provide a dynamic balance to the rope so that during use it has a tendency for the rope to extend straight down from each of the handles 14 and create a generally horizontal flattening of the mid bead free section 22. The mid bead free section 22 extends outwardly in horizontal direction to a greater extent than for conventional jump ropes. As the jump rope strikes the ground or floor, the mid section 22 of the jump rope 10 tends to flatten out for a substantial length, thereby, making it easier for the user to skip or jump over the rope as it passes beneath the user's feet. This prevents the snagging of the rope on the user's feet. The increased weight and balance of the jump rope of the present invention also makes it easier to swing the rope and provides greater feel for the user, thereby, making the jump roping experience more enjoyable. The jump rope of the present invention also encourages the user to stick with an exercise program involving the use of a jump rope.

Adjustments can be made to the overall length of the jump rope 10 and to the groups of beads 16. Each handle 14 has a removable cap at the outer end of the handle which enables the end of the cord to be pushed beyond the end of the handle. The end of the cord has a stop such as a staple which prevents the cord from sliding past the bearing a the inner end of the handle. The length of the rope 10 can be shortened by cutting off an appropriate amount of cord at each end of the cord. A stop is then applied to the end of the cord, the end of the cord is pulled into the handle and the end cap is replaced at the outer end of the handle. Each group of beads 16 can also be altered prior to the application of a new stop. The end of the cord is pulled all the way through the handle. Beads can be added or removed or the beads can be replaced with different beads. The new beads can be larger or smaller or of a different color or material. The end of the cord is then passed through the bearing at the inner end of the handle and a new stop is applied to the end of the cord.

Figure 2:
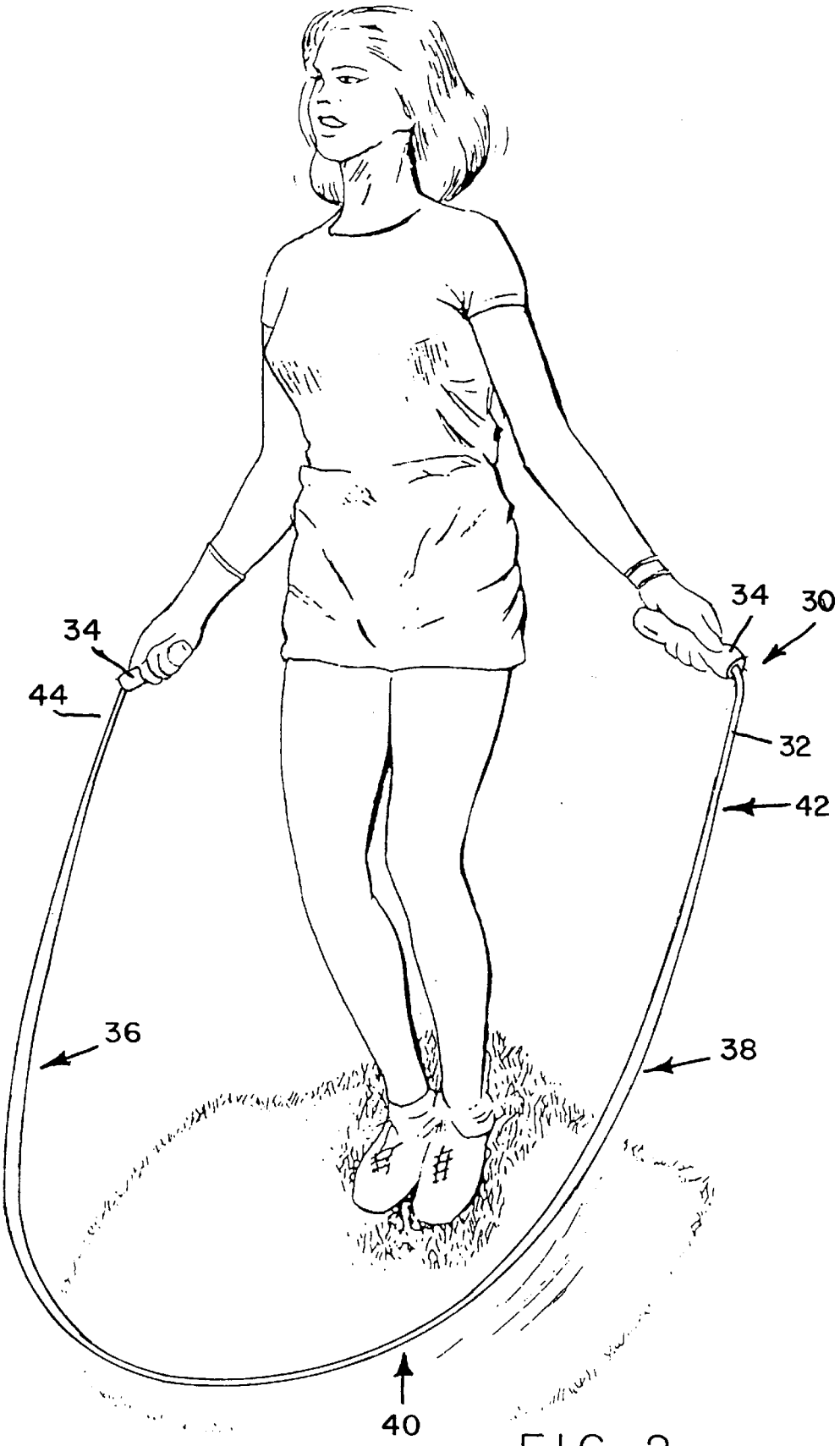
FIG. 2 is an isometric view of a modified jump rope embodying the principals of the present invention and shown in use.

Referring to FIG. 2, it is shown a modified jump rope embodying the principals of the present invention and generally indicated by the reference numeral 30. Jump rope 30 includes a plastic cord 32 connected to a pair of handles 34 which are identical to handles 14 of the embodiment shown in FIG. 1. Cord 32 has a relative thin mid section, generally indicated by the reference numeral 40, and a pair of relatively thin end sections 42 and 44 connected to the handles 34. A first relatively thick intermediate section, generally indicated by the reference numeral 36, is located between the relatively thin end section 44 and the relatively thin mid section 40. A second relatively thick intermediate section, generally indicated by the reference numeral 38, is located between the relatively thin end section 42 and the relatively thin mid section 40. Each of the end sections 42 and 44 has a constant diameter of approximately ¼ inch adjacent each of the handles 34. The middle portion of the mid section 40 also has a constant diameter of approximately ¼ inch. Each of the intermediate sections 36 and 38 has a constant diameter of approximately ½ inch in the mid portion of each of these sections. The diameter of each of the intermediate sections 36 and 38 tapers at each end of the section toward thin sections of the rope. Each intermediate section 36 and 38 is defined as a point at each end of the section which is between ¼ inch and ½ in diameter. The location of these points also defines the length of each of the end sections 32 and 44 in the mid section 40. The relative lengths of the intermediate sections 36 and 38, the end sections 42 and 44, and the mid section 40 are the same as described for the embodiment shown in FIG. 1. It is preferred that the average weight per unit length of the cord in each of the intermediate sections 36 and 38 is approximately 3 times that of the average weight per unit length of the cord in each of the end sections 32 and 34 and the mid section 40. The jump rope 30 provides all of the same advantages described for the embodiment shown in FIG. 1.

The weight to unit length of the intermediate sections 38 and 40 can be from two to four times the weight per unit length of the mid and end sections of the cord 32 for enabling all individuals to experience an improved rope skipping performance and to provide all of the advantages of the present invention.

The jump rope 30 is made by plastic extrusion. The different thicknesses are achieved by selectively varying the pulling tension of the plastic as it is drawn from the plastic extruder.

What is claimed is:

1. A jump rope consisting of a first handle, a second handle and an elongated cord extending from said first handle to said second handle, said cord comprising:

(a) a first end portion connected to said first handle;

(b) a second end portion connected to said second handle;

(c) a mid portion at the middle of said cord;

(d) a first intermediate portion between said first end portion and said mid portion; and (e) a second intermediate portion between said second end portion and said mid portion, each of said first intermediate portion and said second intermediate portion having a weight per unit length that is two to four times that of each of said first end portion, said second end portion and said mid portion, said cord being a length of solid material having a substantially greater thickness at each of said first intermediate portion and said second intermediate portion relative to the mid portion and first and second end portions of said cord.

2. The jump rope as recited in claim 1, wherein said cord tapers gradually from each of said first and second intermediates portions and each of said mid portion and the corresponding one of said first and second end portion, the length of each of said first and second intermediate portions being between points where the diameter of said cord is intermediate the maximum diameter of said first and second intermediate portions and the minimum diameter of each of said mid portion and said first and second end portions.

3. The jump rope as recited in claim 2, wherein said cord is made of a thermoplastic material and, wherein maximum diameter is substantially 0.5 inches and said minimum diameter is substantially 0.25 inches.

4. A jump rope consisting of a first handle, a second handle and an elongated cord extending from said first handle to said second handle, said cord comprising:

(a) a first end portion connected to said first handle, said first end portion being from 8% to 12% of the total length of the cord;

(b) a second end portion connected to said second handle, said second end portion being 8% to 12% of the total length of the cord;

(c) a mid portion at the middle of said cord;

(d) a first intermediate portion between said first end portion and said mid portion, said first intermediate portion being substantially heavier per unit length than said mid portion and each of said first and second end portions, said first intermediate portion being from 18% to 24% of the total length of the cord; and (e) a second intermediate portion between said second end portion and said mid portion, said second intermediate portion being substantially heavier per unit length than that of said mid portion and each of said first and second portions, said second intermediate portion being from 18% to 24% of the total length of the cord, said cord being a length of said material having a substantially greater thickness at each of said first intermediate portion and said second intermediate portion relative to the mid portion and first and second end portions of said cord.

5. The jump rope as recited in claim 4, wherein said cord tapers gradually from each of said first and second intermediates portions and each of said mid portion and the corresponding one of said first and second end portion, the length of each of said first and second intermediate portions being between points where the diameter of said cord is intermediate the maximum diameter of said first and second intermediate portions and the minimum diameter of each of said mid portion and said first and second end portions.

6. The jump rope recited in claim 5, wherein said cord is made of a thermoplastic material and, wherein said maximum diameter is substantially 0.5 inches and said minimum diameter is substantially 0.25 inches.

* * * * *